US010589328B2

(12) United States Patent
Seilinger

(10) Patent No.: US 10,589,328 B2
(45) Date of Patent: Mar. 17, 2020

(54) ROLL CROWN FOR THE SPECIFIC AVOIDANCE OF QUARTER WAVES

(71) Applicant: Primetals Technologies Austria GmbH, Linz (AT)

(72) Inventor: Alois Seilinger, Linz (AT)

(73) Assignee: PRIMETALS TECHNOLOGIES AUSTRIA GMBH (AT)

( * ) Notice: Subject to any disclaimer, the term of this patent is extended or adjusted under 35 U.S.C. 154(b) by 157 days.

(21) Appl. No.: 15/744,158

(22) PCT Filed: May 12, 2016

(86) PCT No.: PCT/EP2016/060724
§ 371 (c)(1),
(2) Date: Jan. 12, 2018

(87) PCT Pub. No.: WO2017/016695
PCT Pub. Date: Feb. 2, 2017

(65) Prior Publication Data

US 2018/0200769 A1 Jul. 19, 2018

(30) Foreign Application Priority Data

Jul. 28, 2015 (EP) ..... 15178612

(51) Int. Cl.
*B21B 31/18* (2006.01)
*B21B 13/14* (2006.01)

(52) U.S. Cl.
CPC ..... *B21B 31/18* (2013.01); *B21B 13/142* (2013.01); *B21B 2267/18* (2013.01); *B21B 2267/20* (2013.01); *B21B 2269/12* (2013.01)

(58) Field of Classification Search
CPC ..... B21B 2269/12; B21B 2269/14; B21B 2269/16; B21B 2269/18; B21B 37/40; B21B 37/42; B21B 13/142; B21B 31/18
See application file for complete search history.

(56) References Cited

U.S. PATENT DOCUMENTS 4,440,012 A * 4/1984 Feldmann ..... B21B 13/142 72/201
4,519,233 A * 5/1985 Feldmann ..... B21B 31/18 72/241.4

(Continued)

FOREIGN PATENT DOCUMENTS

CN 87 1 03686 A 12/1987
CN 101045240 A 10/2007

(Continued)

OTHER PUBLICATIONS

Office Action dated May 13, 2019 in corresponding Japanese Application No. 2018-504231.

(Continued)

*Primary Examiner* — Pradeep C Battula
(74) *Attorney, Agent, or Firm* — Ostrolenk Faber LLP

(57) ABSTRACT

A roller stand (1) that has a roller stand frame (3) in which working rollers (4, 5), or working rollers (4, 5) and support rollers (8, 9), or working rollers (4, 5), intermediate rollers (10, 11), and support rollers (8, 9) are mounted. Each roller (4, 5, 8, 9, 10, 11) can be rotated about a respective rotational axis (6, 7). In a roller stand (1) without intermediate rollers (10, 11), the working rollers (4, 5) can be moved relative to one another in the direction of the respective rotational axis (6, 7), i.e. axially. In a roller stand (1) with intermediate rollers (10, 11), the same applies to the working rollers (4, 5) or the intermediate rollers (10, 11). Each of the axially movable rollers (4, 5 or 10, 11) has an effective barrel length (L) and a curved contour (R1, R2) which extends over the entire effective barrel length (L). Each of the axially movable rollers (4, 5 or 10, 11) has a contour (R1, R2) made by superimposing a respective base function (B1, B2) with a respective additional function (Z1, Z2). The base functions (B1, B2) and the additional functions (Z1, Z2) are functions of the location (x) in the direction of the respective rotational (Continued)

axis (6, 7). The base functions (B1, B2) are determined so as to complement each other in a specified relative axial position in an unloaded state of the axially movable rollers (4, 5 or 10, 11) and form a convex or concave roller gap profile depending on a movement direction upon being moved from the axial position. The sum of the additional functions (Z1, Z2) is a symmetrical function, which is monotonous on both sides, with respect to the barrel center of the axially movable rollers (4, 5 or 10, 11) in the unmoved state.

7 Claims, 4 Drawing Sheets

(56) References Cited

U.S. PATENT DOCUMENTS

| | | | | |
|---|---|---|---|---|
| 4,656,859 | A * | 4/1987 | Ginzburg | B21B 13/142 72/243.6 |
| 4,800,742 | A | 1/1989 | Feldmann et al. | 72/247 |
| 5,622,073 | A * | 4/1997 | Hiruta | B21B 13/142 72/247 |
| 6,119,500 | A * | 9/2000 | Ginzburg | B21B 37/40 72/10.1 |
| 7,367,209 | B2 * | 5/2008 | Ritter | B21B 13/142 72/242.4 |
| 8,210,015 | B2 | 7/2012 | Kneppe et al. | 72/247 |
| 8,413,476 | B2 * | 4/2013 | Seilinger | B21B 13/142 72/247 |
| 8,881,569 | B2 | 11/2014 | Seilinger et al. | 72/252.5 |
| 9,180,503 | B2 * | 11/2015 | Seidel | B21B 13/142 |
| 9,789,521 | B2 * | 10/2017 | Minichmayr | B21B 13/142 |
| 2005/0028575 | A1 * | 2/2005 | Honjo | B21B 13/142 72/243.6 |
| 2005/0034501 | A1 | 2/2005 | Seilinger et al. | 72/252.5 |
| 2007/0095121 | A1 * | 5/2007 | Ritter | B21B 13/142 72/247 |
| 2009/0314047 | A1 | 12/2009 | Seilinger et al. | 72/252.5 |
| 2012/0000263 | A1 * | 1/2012 | Wachsmann | B21B 13/142 72/236 |
| 2013/0008220 | A1 | 1/2013 | Minichmayr et al. | 72/224 |

FOREIGN PATENT DOCUMENTS

| | | | |
|---|---|---|---|
| CN | 101214501 | A | 7/2008 |
| CN | 101367092 | A | 2/2009 |
| CN | 101466483 | A | 6/2009 |
| CN | 101511498 | A | 8/2009 |
| CN | 101569894 | A | 11/2009 |
| CN | 102641892 | A | 8/2012 |
| JP | H11-57821 | A | 3/1999 |
| JP | 2000-015308 | A | 1/2000 |
| JP | 2007-007696 | A | 1/2007 |
| JP | 2007-515296 | A | 6/2007 |
| JP | 2008-307586 | A | 12/2008 |
| WO | WO 03/022470 | A1 | 3/2003 |
| WO | WO 2005/065853 | A2 | 7/2005 |
| WO | WO 2007/144161 | A1 | 12/2007 |
| WO | WO 2007/144162 | A1 | 12/2007 |
| WO | WO 2011/069756 | A1 | 6/2011 |

OTHER PUBLICATIONS

Office Action dated Nov. 19, 2018 issued in corresponding Chinese Patent Application No. 201680043955.2 (without English translation).

International Search Report dated Jul. 13, 2016 in corresponding PCT International Application No. PCT/EP2016/060724.

Written Opinion dated Jul. 13, 2016 in corresponding PCT International Application No. PCT/EP2016/060724.

European Search Report dated Jan. 14, 2016 in corresponding European Patent Application No. 15178612.6.

* cited by examiner

ROLL CROWN FOR THE SPECIFIC AVOIDANCE OF QUARTER WAVES

CROSS-REFERENCE TO RELATED APPLICATIONS

The present application is a 35 U.S.C. §§ 371 national phase conversion of PCT/EP2016/060724, filed May 12, 2016, which claims priority of European Patent Application No. 15178612.6, filed Jul. 28, 2015, the contents of which are incorporated by reference herein. The PCT International Application was published in the German language.

BACKGROUND OF THE INVENTION

The present invention is based on a roll stand for producing flat rolled stock, in particular metal strip,

- wherein the roll stand has roll stand uprights,
- wherein work rolls or work rolls and backup rolls or work rolls, intermediate rolls and backup rolls are mounted in the roll stand uprights,
- wherein the rolls mounted in the roll stand uprights are rotatable about a respective rotational axes,
- wherein, where work rolls or work rolls and backup rolls are mounted in the roll stand uprights, the work rolls are displaceable with respect to one another in the direction of their respective rotational axes, i.e. axially, and in the case where work rolls, intermediate rolls and backup rolls are mounted in the roll stand uprights, the work rolls or the intermediate rolls are displaceable with respect to one another in the direction of their respective rotational axes, i.e. axially,
- wherein the rolls that are axially displaceable with respect to one another have in each case an effective barrel length,
- wherein the rolls that are axially displaceable with respect to one another have in each case a curved contour, which extends over the entire effective barrel length.

Such a roll stand is known for example from WO 03/022 470 A1.

In known roll stands, the contour of one of the two rolls that are axially displaceable with respect to one another is formed by a first basis function, the contour of the other of the two rolls that are axially displaceable with respect to one another is formed by a second basis function. The basis functions are functions of the location seen in the direction of the respective rotational axes. They are also determined so that they complement one another in a specific relative axial position in the unloaded state of the two rolls that are axially displaceable with respect to one another and, when there is a displacement from this axial position, form a convex or concave roll gap profile, depending on the direction of displacement.

To create even rolled stock, for example a metal strip or a plate, with a defined cross-sectional profile, it is necessary to use contour-influencing measures. Examples of such measures are the use of roll bending devices, by means of which the application of rolling force to the rolled stock and the thickness distribution over the width of the rolled stock can be specifically influenced.

For influencing the cross-sectional profile, it is known to use work rolls of a bottleneck-shaped barrel contour. Examples of such shapes are known to those skilled in the art by the terms CVC (CVC is a registered trademark of SMS Siemag AG) and SmartCrown (SmartCrown is a registered trademark of the applicant). In particular, the shape of a SmartCrown contour is explained in detail in the document cited at the beginning WO 03/022 470 A1.

The bottleneck shape of the barrel contour is used not only on work rolls, but also on intermediate rolls and backup rolls. WO 2011/069756 A1 discloses for example a roll stand for producing flat rolled stock,

- wherein the roll stand has work rolls, which are supported on backup rolls or intermediate rolls and backup rolls,
- wherein the work rolls and/or the intermediate rolls and/or the backup rolls are arranged axially displaceably with respect to one another in the roll stand,
- wherein the work rolls and the backup rolls and also—if present, the intermediate rolls have in each case an effective barrel length,
- wherein each roll of at least one pair of rolls formed by a backup roll and a work roll or by a backup roll and an intermediate roll has a curved contour extending over the entire effective barrel length,
- wherein the contour of the backup roll is formed by superposing a basis function with a concave or convex additional function,
- wherein, in an undisplaced state, a contour of the backup roll has a complementary shape in relation to the adjacent work roll or intermediate roll according to the basis function and, when there is a displacement, forms a convex or concave differential profile, depending on the direction of displacement.

The superposing of the basis function with the additional function serves the purpose of reducing the maximum pressures acting on the work roll and the backup roll or on the intermediate roll and the backup roll, and of thereby increasing roll service lives and avoiding roll breakages as far as possible. The additional function is a quadratic function.

WO 2007/144 162 A1 discloses a roll stand for producing flat rolled stock,

- wherein the roll stand has work rolls, which are supported on backup rolls or intermediate rolls and backup rolls,
- wherein the work rolls and/or the intermediate rolls have in each case an effective barrel length,
- wherein the work rolls and/or the intermediate rolls have a curved contour, which extends over the entire effective barrel length and can be described by a trigonometric function,
- wherein these barrel contours complement one another only in a specific relative axial position of the rolls of the pair of rolls in the unloaded state,
- wherein the backup rolls have a complementary barrel contour and, in the unloaded state, there is partial or complete complementing of the barrel contours of the backup rolls and the directly adjacent work rolls or intermediate rolls.

A similar disclosure content can be taken from WO 2007/144 161 A1.

When rolling rolled stock, it is a general endeavor that, after the rolling, the rolled stock has a predetermined profile and is still even. Unevennesses in the rolled stock can occur in particular whenever the rolled stock is relatively thin and the relative profile of the rolled stock is changed too much during the respective rolling pass, that is whenever an uneven reduction in thickness or pass reduction takes place, seen over the width of the rolled stock. Depending on the position of the unevennesses over the width, reference is made to edge, center or quarter waves. In the prior art, edge waves and center waves can be eliminated by conventional adjusting elements such as roll displacement and roll bending. In the case of quarter waves, this is considerably more difficult.

In the prior art, a specific suppression of quarter waves by means of zonal cooling is known for cold rolling mills. In the case of hot rolling, dynamic roll cooling can be used for suppressing quarter waves. This dynamic roll cooling brings about uneven cooling, seen over the width of the rolled stock, and consequently a corresponding thermal crown of the rolls. However, this way of influencing the crown is relatively limited in its effectiveness and is also slow to take effect. It is also possible to suppress quarter waves by a specific combination of displacement and bending of the work rolls. This however presupposes that there is a sufficiently great adjusting range of the roll bending. Roll bending is however usually used in the prior art primarily for allowing a response to deviations in the rolling force during the rolling of the rolled stock, in order in particular to keep the relative or absolute rolled stock profile constant and to ensure evenness.

SUMMARY OF THE INVENTION

The object of the present invention is to provide a roll stand in which the shape of the roll gap, i.e. the thickness profile of the roll gap over the barrel length, is varied by axially displacing rolls in such a way that even and wave-free rolled stock that satisfies the highest quality demands is achieved.

According to the invention, a roll stand of the type mentioned at the beginning is designed

- such that one of the two rolls that are axially displaceable with respect to one another has a first contour, which is formed by superposing a first basis function and a first additional function,
- such that the other of the two rolls that are axially displaceable with respect to one another has a second contour, which is formed by superposing a second basis function and a second additional function,
- wherein the basis functions satisfy the relationships $$B1 = +A \cdot \sin\left(\frac{2\varphi}{L_{Ref}}(x+c)\right) - B \cdot x \text{ and}$$

$$B2 = -A \cdot \sin\left(\frac{2\varphi}{L_{Ref}}(x-c)\right) + B \cdot x$$

or the relationships $$B1=+A'(x+c)^5+A(x+c)^3-B\cdot x$$

and $$B2=-A'(x-c)^5-A(x-c)^3+B\cdot x$$

and the additional functions (Z1, Z2) satisfy the relationships $$Z1=-\alpha\cdot Cx^2-\beta\cdot Dx^4$$

and $$Z2=-(2-\alpha)\cdot Cx^2-(2-\beta)\cdot Dx^4$$

or the relationships $$Z1=-\alpha\cdot C\cos\lambda x$$

and $$Z2=-(2-\alpha)\cdot C\cos\lambda x$$

where

- B1 and B2 are the first and second basis functions,
- Z1 and Z2 are the first and second additional functions,
- A and A' are contour amplitudes,
- $\varphi$ is a contour angle,
- $L_{Ref}$ is a reference length,
- x is the location or the axial position, with respect to the center of the barrel,
- c is a contour displacement,
- B is a contour pitch,
- $\alpha$ and $\beta$ are weighting factors,
- C and D are proportional factors and
- $\lambda$ is a factor.

On the basis of this design of the contours of the two rolls that are axially displaceable with respect to one another, quarter waves can be suppressed by the roll crown alone. This is so because this crown achieves that the equivalent crown of the two rolls that are axially displaceable with respect to one another is provided with an offset. The offset is generally positive, and is only negative in exceptional cases. The equivalent crown is the crown of conventionally (that is symmetrically) ground rolls, which produce the same roll gap profile in the unloaded state or load-free state.

It is possible that the contour displacement lies within the actually achievable range of displacement of the two rolls that are axially displaceable with respect to one another. Alternatively, the contour displacement may lie outside the actually achievable range of displacement. In the latter case, the two basis functions always form a convex roll gap profile or always form a concave roll gap profile independently of the actual displacement. In this case, it is just possible in the mathematical sense that there is also a reversal of the sign.

The design according to the invention of the two axially displaceable rolls facilitates both the mathematical description of the contours of the two rolls that are axially displaceable with respect to one another and also the technical production of the contours of the two rolls that are axially displaceable with respect to one another.

It is of particular advantage if the additional functions are symmetric to one another. By this design, it can be achieved in particular that the two rolls that are axially displaceable with respect to one another can be ground in the same way and all that is necessary is for one of the two rolls to be fitted into the roll stand after being turned 180° with respect to the other.

It is possible that the roll stand does not have any further rolls apart from the work rolls. However, the work rolls are generally supported on backup rolls directly or by way of intermediate rolls. In the case where only backup rolls are present (for example a four-high stand), the contours of the backup rolls may be provided with an inverse additional contour, so that the backup rolls and the work rolls complement one another in the undisplaced, unloaded state. Alternatively, it is possible that the contours of the backup rolls differ from those of the work rolls, in particular by a concave difference. Where both backup rolls and intermediate rolls are present (for example in a six-high stand), the contours of the intermediate rolls may differ from those of the work rolls and/or of the backup rolls by such a concave difference. By this design, maximum pressures acting between rolls that are adjacent to one another can be minimized.

The properties, features and advantages of this invention that are described above and the manner in which they are achieved become clearer and more clearly understandable in connection with the following description of the exemplary embodiments, which are described more specifically in connection with the drawings, in which:

DESCRIPTION OF EMBODIMENTS

Figure 1:
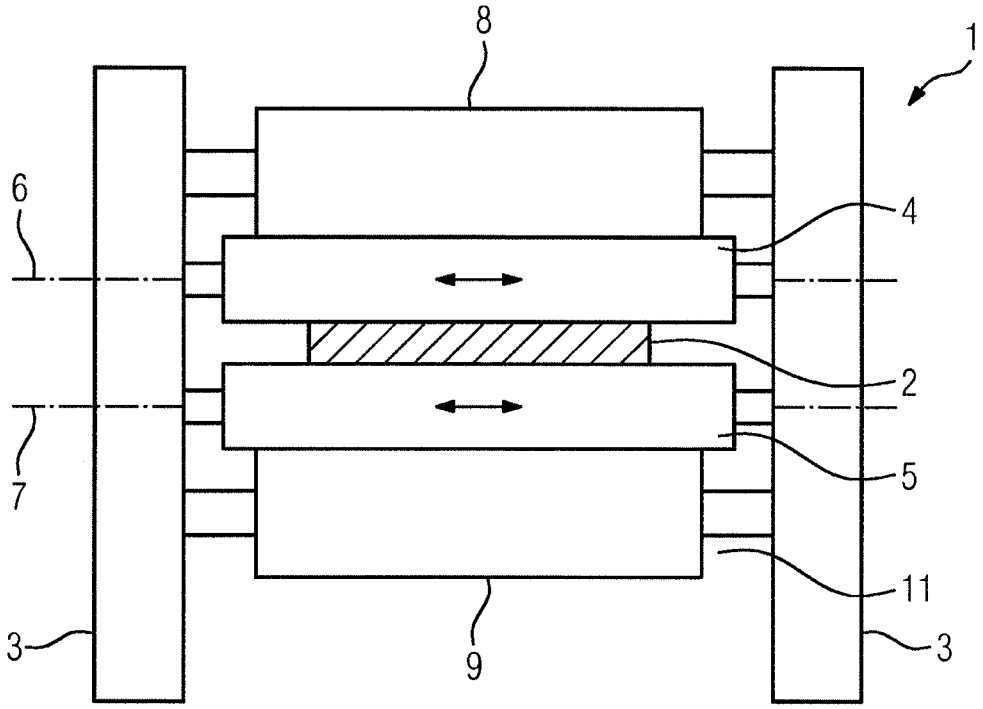
FIGS. 1 and 2 respectively show a roll stand in a schematic representation, FIGS. 3 and 4 respectively show two work rolls in a schematic representation.
Figure 2:
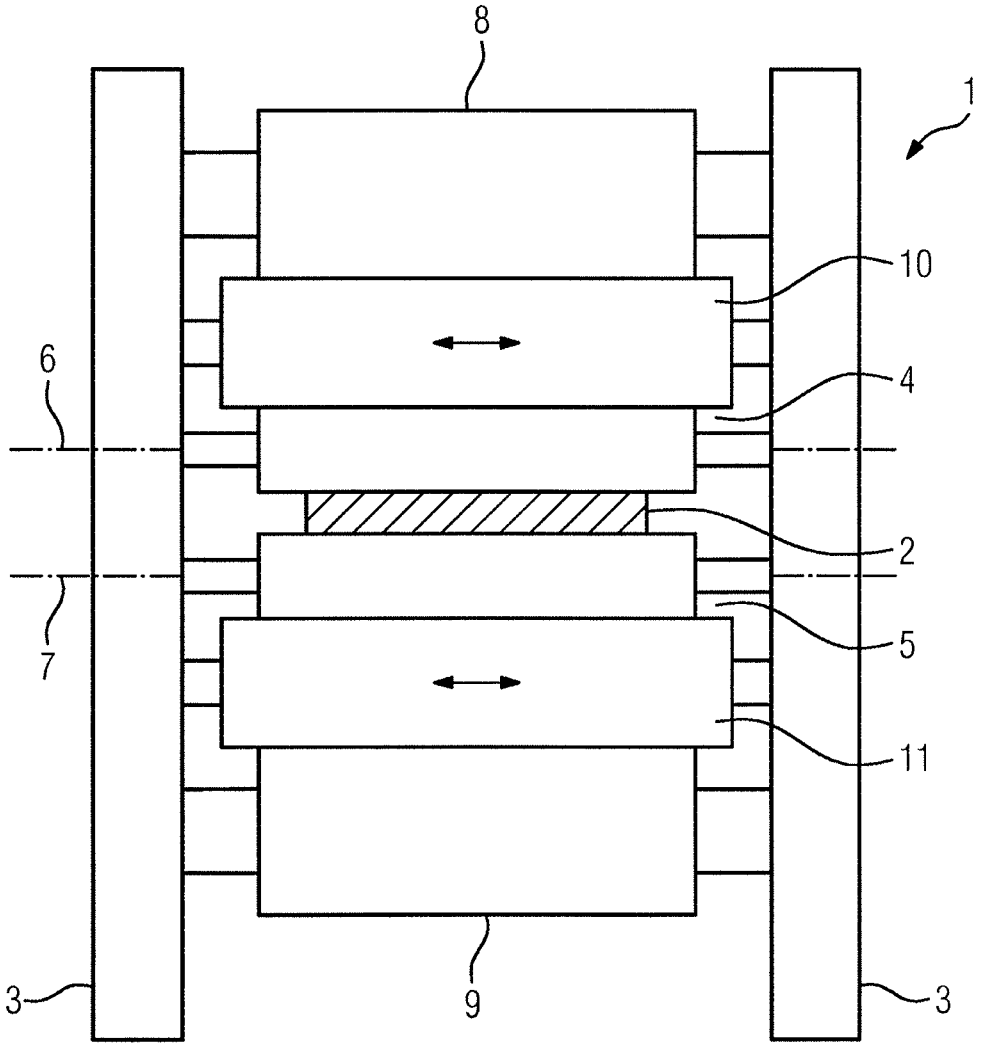

In a roll stand that is provided generally with the reference sign 1, it is intended according to FIGS. 1 and 2 for a flat rolled stock 2 to be rolled and thereby produced. The rolled stock 2 may consist in particular of metal, for example of aluminum or steel. It may be a strip or a plate.

According to FIGS. 1 and 2, the roll stand 1 has roll stand uprights 3. Mounted in the roll stand uprights 3 are a first and a second work roll 4, 5. The work rolls 4, 5 are mounted as is generally customary, in the roll stand uprights 3 in such a way that each work roll 4, 5 is rotatable about a respective rotational axis 6, 7. The rotation is brought about by a common drive assigned to the work rolls 4, 5 or by drives respectively assigned to one of the work rolls 4, 5. The drive or drives is or are not included in the representations in the figures.

In a way corresponding to the representation in FIGS. 1 and 2, the first work roll 4 is the upper work roll. Corresponding hereto, the second work roll 5 is the lower work roll. The reverse assignment is however similarly possible.

It is possible that the roll stand 1 has no further rolls apart from the work rolls 4, 5 (two-high stand). Generally, however, in a way corresponding to the representation in FIGS. 1 and 2, the work rolls 4, 5 are supported on backup rolls 8, 9. It is possible in a way corresponding to the representation in FIG. 1 that the roll stand 1 does not have any further rolls apart from the work rolls 4, 5 and the backup rolls 8, 9 (for example in the case of a four-high stand). In this case, the work rolls 4, 5 are supported on the backup rolls 8, 9 directly. Alternatively—for example in the case of a six-high stand, it is possible in a way corresponding to the representation in FIG. 2 that the roll stand 1 additionally has intermediate rolls 10, 11. In this case, the work rolls 4, 5 are supported on the backup rolls 8, 9 by way of the intermediate rolls 10, 11. The further rolls, that is the backup rolls 8, 9 and, if appropriate, also the intermediate rolls 10, 11, are also mounted in the roll stand uprights 3, so that each role is rotatable about its respective rotational axes.

Two of the rolls 4, 5, 8, 9, 10, 11 are mounted in the roll stand uprights 3 in such a way that they are axially displaceable with respect to one another. In the case of a two-high stand and also in the case of a four-high stand, the two rolls that are axially displaceable with respect to one another are the work rolls 4, 5. The displacements consequently take place in the direction of their rotational axes 6, 7. The displaceability is indicated in FIG. 1 by corresponding double-headed arrows on the work rolls 4, 5. In the case of a six-high stand, the two rolls that are axially displaceable with respect to one another are generally the intermediate rolls 10, 11. The displaceability is indicated in FIG. 2 by corresponding double-headed arrows on the intermediate rolls 10, 11. The work rolls 4, 5 generally have in this case a relatively small diameter and are cylindrical or slightly crowned (symmetrically). In individual cases, however, as an alternative or in addition to the intermediate rolls 10, 11, in a six-high stand the work rolls 4, 5 may also be axially displaceable with respect one another. In this case, the work rolls 4, 5, if appropriate in addition to the intermediate rolls 10, 11, have corresponding contours.

Irrespective of whether the work rolls 4, 5 or the intermediate rolls 10, 11 are axially displaceable with respect to one another, the displacement of the corresponding rolls 4, 5 or 10, 11 always takes place oppositely. Therefore, if one work roll 4, 5 or intermediate roll 10, 11 is displaced by a specific amount in the positive direction, the other work roll 5, 4 or intermediate roll 11, 10 is displaced by the same amount in the negative direction.

Figure 3:
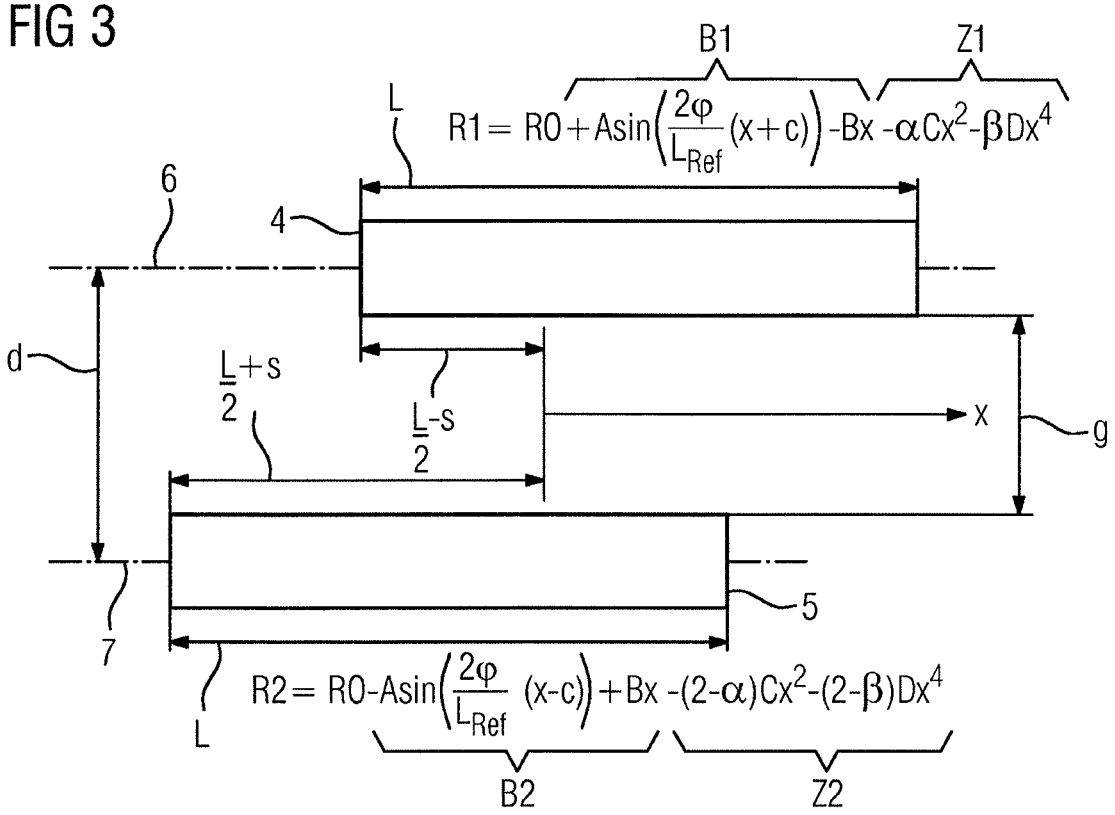

Each set of two rolls 4, 5 or 10, 11 that respectively are axially displaceable with respect to one another, that is either the two work rolls 4, 5 or the two intermediate rolls 10, 11, have an effective barrel length L according to FIG. 3. The equations for the radius R1, R2 of the respective roll 4, 5 or 10, 11 that are indicated above and below the respective roll 4, 5 and 10, 11 in FIG. 3, show the corresponding rolls 4, 5 or 10, 11 each have a curved peripheral contour, which extends over the entire effective barrel length L. The radii R1, R2 as a function over the location x along the rotational axes 6, 7 correspond to the contours of the rolls 4, 5 or 10, 11.

According to FIG. 3, the two rolls 4, 5 or 10, 11 that are axially displaceable with respect to one another have initially a base radius R0. The base radius R0 is constant, that is, it is not a function of the location x along the rotational axis 6 of the first work roll 4 or of the location x along the rotational axis 7 of the second work roll 5 or the rotational axes of the intermediate rolls 10, 11. This base radius R0 is superposed in the case of the first work roll 4 (or the intermediate roll 10 adjacent to the first work roll 4) by a first basis function B1, in the case of the second work roll 5 (or the intermediate roll 11 adjacent to the second work roll 5) by a second basis function B2. According to FIG. 3, the basis functions B1, B2 are functions of the location x in the direction of the respective rotational axis 6, 7.

The basis functions B1, B2 are preferably antisymmetric to one another, with respect to the center of the barrel. They are therefore odd functions in the mathematical sense. The relationship B1($x$)=−B2(−x) therefore applies. The basis functions B1, B2 are determined in such a way that they complement one another in a specific relative axial position of the corresponding rolls 4, 5 or 10, 11 in the unloaded state of the corresponding rolls 4, 5 or 10, 11 and, when there is a displacement from this axial position, form a convex or concave roll gap profile, depending on the direction of displacement.

For example, the following relationships apply to the first basis function B1 and the second basis function B2 according to FIG. 3

$$B1 = +A \cdot \sin\left(\frac{2\varphi}{L_{Ref}}(x+c)\right) - B \cdot x \tag{1}$$

$$B2 = -A \cdot \sin\left(\frac{2\varphi}{L_{Ref}}(x-c)\right) + B \cdot x \tag{2}$$

In equations 1 and 2, x is the location or the axial position, with respect to the center of the barrel, A is a contour amplitude, φ is a contour angle, c is a contour displacement, $L_{Ref}$ is a reference length and B is a contour pitch.

The meaning of these variables is explained in the document cited at the beginning WO 03/022 470 A1. Possible values for the contour angle φ and a dimensioning specification for the contour pitch B are also indicated there. The reference length $L_{Ref}$ may be identical to the barrel length L. Alternatively, it may be a different value.

As can be seen, the basis functions B1, B2 are determined in such a way that they complement one another in a specific relative axial position of the corresponding rolls 4, 5 or 10, 11 in the unloaded state of the corresponding rolls 4, 5 or 10, 11. This axial position is reached when the first work roll 4 (or the intermediate roll 10 adjacent to the first work roll 4) is displaced by the contour displacement c in the positive direction and the second work roll 5 (or the intermediate roll 11 adjacent to the second work roll 5) is displaced by the contour displacement c in the negative direction. If, on the other hand, starting from this axial position, a displacement of the first work roll 4 (or of the intermediate roll 10 adjacent to the first work roll 4) takes place in the positive direction and, corresponding hereto, a displacement of the second work roll 5 (or of the intermediate roll 11 adjacent to the second work roll 5) takes place in the negative direction, the basis functions B1, B2 form a convex roll gap profile. If, conversely, starting from this axial position, a displacement of the first work roll 4 (or of the intermediate roll 10 adjacent to the first work roll 4) takes place in the negative direction and, corresponding hereto, a displacement of the second work roll 5 (or of the intermediate roll 11 adjacent to the second work roll 5) takes place in the positive direction, the basis functions B1, B2 form a concave roll gap profile. Furthermore, on the basis of the specification of the basis functions B1, B2 according to FIG. 3, the basis functions B1, B2 are antisymmetric to one another, with respect to the center of the barrel.

The first basis function B1 is additionally superposed with an additional function Z1. In an analogous way, the second basis function B2 is additionally superposed with an additional function Z2. According to FIG. 3, the additional functions Z1, Z2 are—in a way analogous to the basis functions B1, B2—functions of the location x in the direction of the respective rotational axis 6, 7.

For example, the following relationships apply to the first additional function Z1 and the second additional function Z2 according to FIG. 3

$$Z1=-\alpha\cdot Cx^2-\beta\cdot Dx^4 \tag{3}$$

$$Z2=-(2-\alpha)\cdot Cx^2-(2-\beta)\cdot Dx^4 \tag{4}$$

In equations 3 and 4, α and β are weighting factors, which generally have a value of between 0 and 2. The limit values 0 and 2 can also be assumed. In an individual case, still greater or still smaller values may also be assumed. The weighting factors α, β may be determined independently of one another. Preferably, both weighting factors α, β have the value 1. This is accompanied by the advantage that the additional functions Z1, Z2 are symmetric to one another. C and D are proportional factors. The proportional factor C generally has a value above 0. The proportional factor D may, according to requirements, have the value 0, greater than zero or less than zero.

If the two rolls 4, 5 or 10, 11 that are axially displaceable with respect to one another are not displaced with respect to one another (displacement s=0), the center of the barrel of the two rolls 4, 5 or 10, 11 that are axially displaceable with respect to one another is therefore at the same location seen in the direction of the rotational axis 6, 7, the following relationship consequently applies to the sum of the additional functions Z1, Z2, irrespective of the choice of weighting factors α and β

$$Z1+Z2=-2Cx^2-2Dx^4 \tag{5}$$

With respect to the center of the barrel of the two rolls 4, 5 or 10, 11 that are axially displaceable with respect to one another, the sum of the additional functions Z1, Z2 is consequently a symmetric function that is monotonous on both sides.

Strictly speaking, all that is necessary is that, with respect to the center of the barrel of the two rolls 4, 5 or 10, 11 that are axially displaceable with respect to one another in the undisplaced state, the sum of the additional functions Z1, Z2 is a symmetric function that is monotonous on both sides. This preferably also applies however to the additional functions Z1, Z2 taken by themselves. Preferably, therefore, with respect to the center of the barrel, each of the two additional functions Z1, Z2 is a symmetric function that is monotonous on both sides.

Within the scope of the design according to FIG. 3, the first basis function B1 is a trigonometric function which is superposed with a linear function. The trigonometric function may be in particular a sine function. On the other hand, the sum of the additional functions Z1, Z2 is a polynomial function. Starting from the center of the barrel and seen in the direction of the respective rotational axis 6, 7, the polynomial function has at least one second-order proportion. Preferably, to be specific whenever the proportional factor D has a value other than 0, the polynomial function also has a fourth-order proportion.

The standard case, according to which the two weighting factors α, β have the value 1, is dealt with below. If the two weighting factors α, β have a different value, equivalent results are obtained in principle. It is still assumed that the two work rolls 4, 5 are the two rolls that are axially displaceable with respect to one another. If the intermediate rolls 10, 11 are axially displaceable with respect to one another, equivalent results are likewise obtained in principle. If the rotational axes 6, 7 of the work rolls 4, 5 have a distance d from one another and the first work roll 4 is displaced by a displacement s and, corresponding hereto, the second work roll 4 is displaced by the same value in the opposite direction, the following relationship applies in the standard case just outlined to the roll gap g that the work rolls 4, 5 form with one another $$g = d0(s) + 2A\cdot\cos\left(\frac{2\varphi}{L_{Ref}}x\right)\cdot\sin\left(\frac{2\varphi}{L_{Ref}}(s-c)\right) + 2(C+6Ds^2)\cdot x^2 + 2D\cdot x^4 \tag{6}$$

where d0 is a value which, though it depends on the displacement s, does not depend on the location x seen in the direction of the rotational axis 6, 7.

The resultant shape of the roll gap g has on the one hand a convex or concave proportion which is dependent on the displacement s, to be specific the proportion $$2A \cdot \cos\left(\frac{2\varphi}{L_{Ref}}x\right) \cdot \sin\left(\frac{2\varphi}{L_{Ref}}(s-c)\right) \tag{7}$$

However, the resultant shape of the roll gap g additionally has a further convex or concave proportion which is not dependent on the displacement s; to be specific, in the case where the proportional factor D has the value 0, the proportion $$2Cx^2 \tag{8}$$

In the case where the proportional factor D has a value other than 0, the independence of the displacement s applies to the fourth-order proportion.

Figure 4:
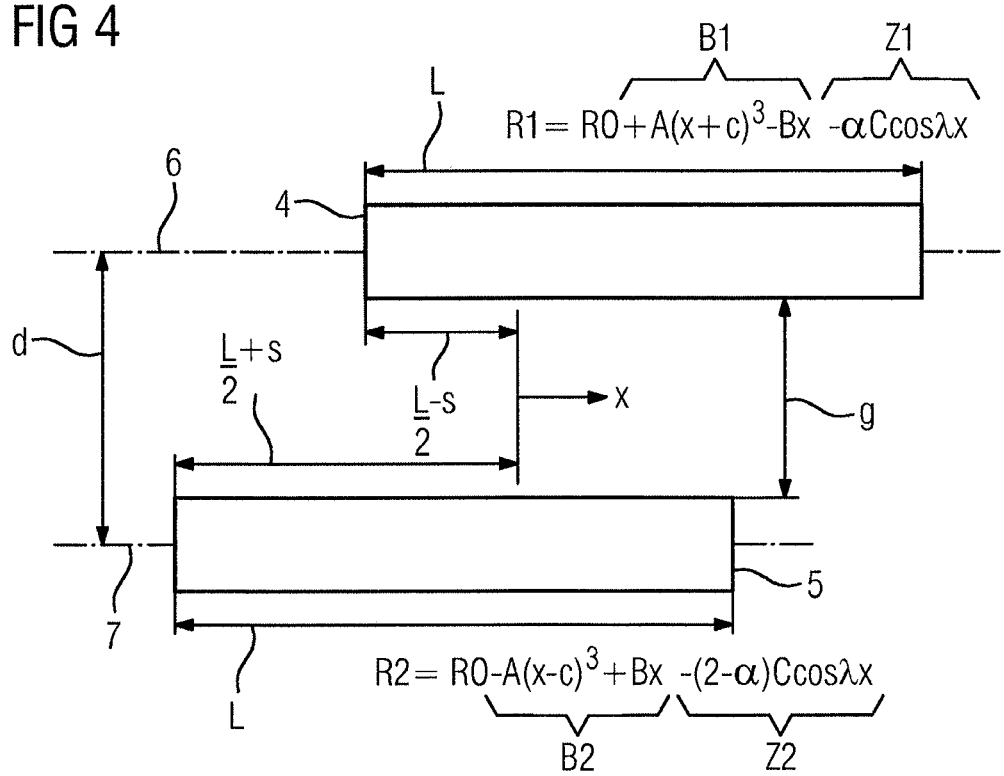

FIG. 4 shows a design similar to FIG. 3. As a difference from FIG. 3, in the case of the design according to FIG. 4, however, the first basis function B1 is a polynomial function. Furthermore, as a difference from FIG. 3, in the case of the design according to FIG. 4 the sum of the additional functions Z1, Z2 is a trigonometric function. In particular, the trigonometric function according to FIG. 4 may be a cosine function. 2 is a suitably chosen factor.

The designs according to FIGS. 3 and 4 can be combined with one another to the extent that the additional functions Z1, Z2 can be chosen independently of the basis functions B1, B2. In the case where the basis functions B1, B2 are linear combinations of a trigonometric function and a linear function, the additional functions Z1, Z2 are therefore not necessarily polynomial functions. They could also be trigonometric functions, in particular trigonometric functions according to FIG. 4. In an analogous way, in the case where the basis functions B1, B2 are polynomial functions, the additional functions Z1, Z2 are not necessarily trigonometric functions. They could also be polynomial functions, in particular polynomial functions according to FIG. 3.

Figure 5:
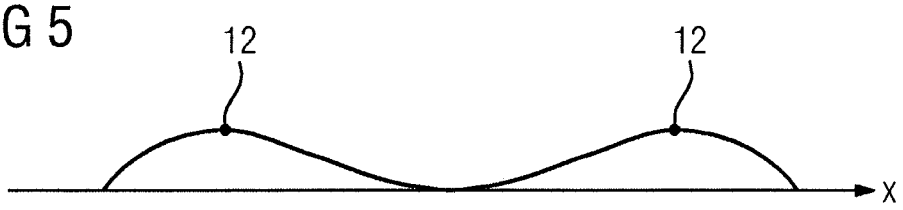
FIG. 5 shows a roll gap formed by two work rolls in a schematic representation.

FIG. 5 shows purely by way of example for the design according to FIG. 3 the deviation of the resultant roll gap g from a mean value. It can be seen in particular from FIG. 5 that, by the superposing of the basis functions B1, B2 with the additional functions Z1, Z2, a very uniform profile can be achieved to a considerable extent. By a corresponding determination of the proportional factors C and D, furthermore, the maxima 12 of the deviation can be influenced both with respect to their position seen in the direction of the rotational axis 6, 7 and with respect to their height.

Figure 6:
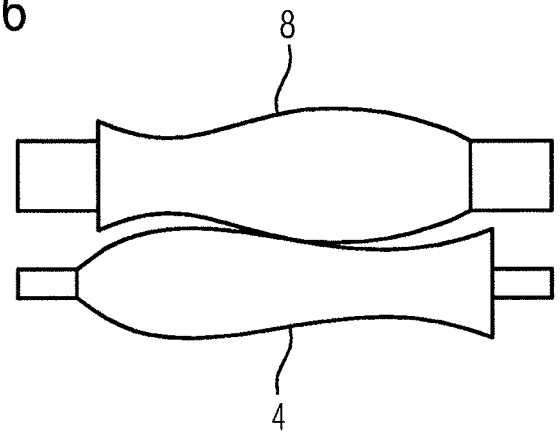
FIG. 6 shows a work roll and a backup roll in a schematic representation and FIG. 7 shows a work roll, an intermediate roll and a backup roll in a schematic representation.
Figure 7:
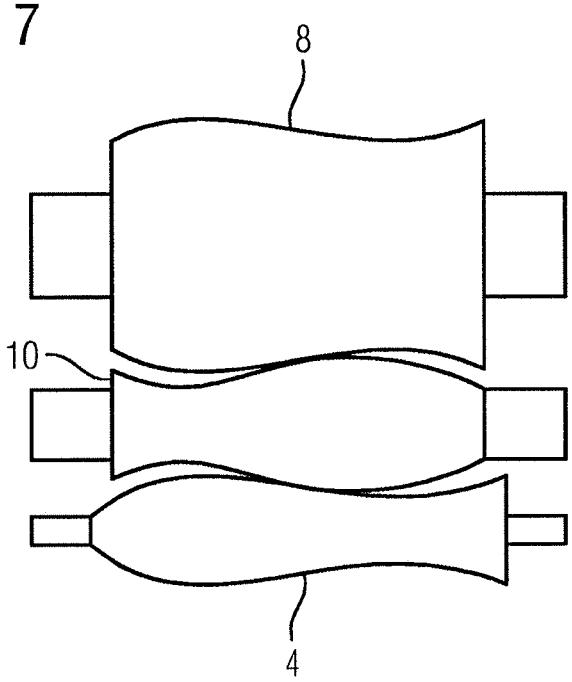

As already mentioned and represented in FIG. 1, backup rolls 8, 9 are often present in addition to the work rolls 4, 5. In this case, it is possible that the contours of the backup rolls 8, 9 differ from those of the work rolls 4, 5 by a concave difference. This is represented in FIG. 6, the difference being shown greatly exaggerated in FIG. 6. As likewise already mentioned and represented in FIG. 2, intermediate rolls 10, 11 may also be present in addition to the work rolls 4, 5 and the backup rolls 8, 9. If in this case (exceptionally) the work rolls 4, 5 are the axially displaceable rolls, it is possible in this case that the contours of the intermediate rolls 10, 11 differ from those of the work rolls 4, 5 and/or of the backup rolls 8, 9 by a concave difference. This is represented in FIG. 7, the differences being shown greatly exaggerated in FIG. 7 in a way analogous to FIG. 6. If, on the other hand (in a way corresponding to the rule in the case of a six-high stand), the intermediate rolls 10, 11 are the axially displaceable rolls, it is possible—in a way analogous to the situation in the case of a four-high stand—that the contours of the backup rolls 8, 9 differ from those of the intermediate rolls 10, 11 by a concave difference.

The present invention has many advantages. In particular, while retaining the advantages of roll stands with axially displaceable rolls 4, 5 or 10, 11, in particular according to the SmartCrown technology, it can be achieved that the adjusting range for influencing the crown that is provided by the displacement of the corresponding rolls 4, 5 or 10, 11 is displaced in a desired target range. If, for example, the crown adjusting range that can be achieved by displacing the work rolls 4, 5 is intended to lie between −400 μm and −100 μm, this can be achieved by providing that the adjusting range would lie between +300 μm and +600 μm if only the basis functions B1, B2 were applied, but a parabolic crown of −700 μm is additionally superposed by the additional functions Z1, Z2. The superposing of the basis functions B1, B2 and the additional functions Z1, Z2 allows not only edge waves and center waves but also quarter waves to be specifically suppressed. The suppression is particularly effective if not only the proportional factor C but also the proportional factor D has a value other than 0.

Although the invention has been illustrated more specifically and described in detail by the preferred exemplary embodiment, the invention is not restricted by the examples disclosed and other variations may be derived therefrom by a person skilled in the art without departing from the scope of protection of the invention.

LIST OF REFERENCE SIGNS

1 Roll stand
2 Rolled stock
3 Roll stand upright
4, 5 Work rolls
6, 7 Rotational axes
8, 9 Backup rolls
10, 11 Intermediate rolls
12 Maxima
A Contour amplitude
B Contour pitch
B1, B2 Basis functions
c Contour displacement
C, D Proportional factors
d Distance between the rotational axes
g Roll gap
L Effective barrel length
$L_{Ref}$ Reference length
R0 Base radius
R1, R2 Radii of the work rolls
s Displacement
x Location in direction of rotational axis
Z1, Z2 Additional functions
α, β Weighting factors
λ Factor
φ Contour angle

The invention claimed is:

1. A roll stand for producing flat rolled stock comprising:
the roll stand has roll stand uprights;
work rolls, or work rolls and backup rolls or work rolls, intermediate rolls and backup rolls are all mounted in the roll stand uprights;
each of the rolls mounted in the roll stand uprights is rotatable about a respective rotational axis;
where the work rolls or the work rolls and backup rolls are mounted in the roll stand uprights, the work rolls are supported in the uprights to be displaceable axially with respect to one another along the directions of their respective rotational axis, and where the work rolls, the intermediate rolls and the backup rolls are mounted in the roll stand uprights, the work rolls or the intermediate rolls are displaceable axially with respect to one another along the directions of their respective rotational axis;

the work rolls or the intermediate rolls that are axially displaceable with respect to one another each has an effective barrel length (L);

the work rolls or the intermediate rolls that are axially displaceable with respect to one another each has a curved contour, which extends over the entire effective barrel axial length (L);

one of the two work rolls or of the two intermediate rolls that are axially displaceable with respect to one another has a first curved contour with a first radius (R1) at each location along the rotational axis thereof, the first radius (R1) corresponding to a combination of a base radius (R0) of the first curved contour and superposition of a first basis function (B1) and a first additional function (Z1);

the other of the two work rolls or of the other two intermediate rolls that are axially displaceable with respect to one another has a second curved contour with a second radius (R2) at each location along the rotational axis thereof, the second radius (R2) corresponding to a combination of a base radius (R0) of the second curved contour and superposition of a second basis function (B2) and a second additional function (Z2);

the basis functions (B1, B2) satisfy the relationships $$B1 = +A \cdot \sin\left(\frac{2\varphi}{L_{Ref}}(x+c)\right) - B \cdot x \text{ and}$$

$$B2 = -A \cdot \sin\left(\frac{2\varphi}{L_{Ref}}(x-c)\right) + B \cdot x$$

or the relationships $$B1=+A'(x+c)^5+A(x+c)^3-B\cdot x \text{ and}$$

$$B2=-A'(x-c)^5-A(x-c)^3+B\cdot x$$

and the additional functions (Z1, Z2) satisfy the relationships $$Z1=-\alpha\cdot Cx^2-\beta\cdot DX^4 \text{ and}$$

$$Z2=-(2-\alpha)\cdot Cx^2-(2-\beta)\cdot Dx^4$$

or the relationships $$Z1=-\alpha\cdot C \cos \lambda x \text{ and}$$

$$Z2=-(2-\alpha)\cdot C \cos \lambda x$$

where

B1 and B2 are the first and second basis functions,

Z1 and Z2 are the first and second additional functions,

A and A' are contour amplitudes, $\varphi$ is a contour angle, $L_{Ref}$ is a reference length, x is the location or the axial position, with respect to the center of the barrel, c is a contour displacement, B is a contour pitch, $\alpha$ and $\beta$ are weighting factors, C and D are proportional factors and $\lambda$ is a factor.

2. The roll stand as claimed in claim 1, wherein the additional functions Z1, Z2 are symmetrical to one another.

3. The roll stand as claimed in claim 2, further comprising backup rolls on which the work rolls are directly supported; and the work rolls and the backup rolls have respective peripheral contours and the backup rolls have contour that differ from the contour of the work rolls by a concave difference.

4. The roll stand as claimed in claim 2, further comprising backup rolls on which the work rolls are supported;

intermediate rolls which support the work rolls on the backup rolls;

the work rolls, the backup rolls and the intermediate rolls have respective peripheral contours; and the contours of the intermediate rolls differ from the contours of at least one of the work rolls and the backup rolls by a respective concave difference.

5. The roll stand as claimed in claim 1, further comprising:

the work rolls are directly supported on the backup rolls; and the work rolls and the backup rolls have respective peripheral contours and the backup rolls have a contour that differ from the contour of the work rolls by a concave difference.

6. The roll stand as claimed in claim 5, further comprising:

intermediate rolls which support the work rolls on the backup rolls;

the work rolls, the backup rolls and the intermediate rolls have respective peripheral contours; and the contours of the intermediate rolls differ from the contours of at least one of the work rolls and the backup rolls by a respective concave difference.

7. The roll stand as claimed in claim 1, further comprising:

the work rolls are supported on the backup rolls;

intermediate rolls which support the work rolls on the backup rolls;

the work rolls, the backup rolls and the intermediate rolls have respective peripheral contours; and the contours of the intermediate rolls differ from the contours of at least one of the work rolls and the backup rolls by a respective concave difference.

* * * * *